US006083056A

United States Patent [19]

Okabe et al.

[11] Patent Number: 6,083,056

[45] Date of Patent: Jul. 4, 2000

[54] COMBINED-TYPE CONNECTOR

[75] Inventors: Toshiaki Okabe; Kentarou Nagai, both of Shizuoka, Japan

[73] Assignee: Yazaki Corporation, Tokyo, Japan

[21] Appl. No.: 09/165,995

[22] Filed: Oct. 2, 1998

[30] Foreign Application Priority Data

Oct. 3, 1997 [JP] Japan ..... 9-271611

[51] Int. Cl.[7] ..... H01R 13/502

[52] U.S. Cl. ..... 439/701; 439/598

[58] Field of Search ..... 439/701, 598, 439/596, 595, 594, 702, 717, 752

[56] References Cited

U.S. PATENT DOCUMENTS

| | | | |
|---|---|---|---|
| 5,122,077 | 6/1992 | Maejima et al. | 439/398 |
| 5,425,656 | 6/1995 | Wakata | 439/595 |
| 5,700,163 | 12/1997 | Okabe | 439/596 |
| 5,888,103 | 3/1999 | Norizuki et al. | 439/701 |
| 5,895,296 | 4/1999 | Okabe | 439/701 |

FOREIGN PATENT DOCUMENTS

| | | | |
|---|---|---|---|
| 2-115252 | 9/1990 | Japan | H01R 4/02 |

*Primary Examiner*—Gary F. Paumen
*Assistant Examiner*—Alexander Gilman
*Attorney, Agent, or Firm*—Sughrue, Mion, Zinn, Macpeak & Seas, PLLC

[57] ABSTRACT

A combined-type connector of a multi-stage construction in which a main housing and an auxiliary housing each having metal terminals are combined together. In the combined-type connector, a fitting hood of the main housing is formed by a rear wall and a peripheral wall defining four side walls, and a combination-purpose insertion port is formed in the rear wall of the fitting hood, and is directed and leads to a region disposed over one side of rear end portions of terminal receiving chambers. A fitting hood of the auxiliary housing is formed by three walls, that is, a wall, disposed forwardly of a press-connection opening, and two walls disposed respectively at opposite sides of this wall, and is inserted into the fitting hood of the main housing through the insertion port, and the thus inserted fitting hood of the auxiliary housing has such a size that the three walls thereof are disposed in contiguous relation to an inner peripheral surface of the fitting hood of the main housing. There is provided a terminal cover for opening and closing the press-connection opening in the auxiliary housing.

7 Claims, 8 Drawing Sheets

COMBINED-TYPE CONNECTOR

BACKGROUND OF THE INVENTION

1. Field of the Invention

This invention relates to a combined-type connector of a multi-stage construction in which a main housing and an auxiliary housing each having metal terminals are combined together.

2. Description of the Related Art

FIG. 8 shows one conventional combined-type connector (see Japanese Utility Model Unexamined Publication No. Hei. 2-115252), and FIGS. 9(*a*), 9(*b*) and 10 show another conventional combined-type connector.

The connector of FIG. 8 comprises sub-housings 1 and 3 stacked together in a two-stage manner, and male metal terminals 9 are received respectively in terminal receiving chambers 5 in the sub-housing 1, and male metal terminals 11 are received respectively in terminal receiving chambers 7 in the sub-housing 3. Male tabs 13 of the male metal terminals 9 project outwardly respectively from the terminal receiving chambers 5 of the sub-housing 1, and male tabs 15 of the male metal terminals 11 project outwardly respectively from the terminal receiving chambers 7 of the sub-housing 3. A hood 19 is fitted on fitting portions 17 of the sub-housings 1 and 3, thereby constituting the combined-type connector.

The connector, shown in FIGS. 9(*a*), 9(*b*) and 10, comprises two housings 21 and 23 each having a terminal receiving chamber 5, 7 in which a male metal terminal 9, 11 is received, and a male tab 13, 15 of the male metal terminal 9, 11 projects outwardly from the terminal receiving chamber 5, 7. Half fitting hoods 25 and 27 are formed integrally with the housings 21 and 23, respectively. A terminal cover 33, 35 is provided so as to close an opening 29, 31 (for press-connection purposes) after a wire (not shown) is press-connected to the male metal terminal 9, 11. The terminal cover 33, 35 is connected by a hinge 37, 39 to the housing 21, 23 so as to be turned or pivotally moved, and the terminal cover 33, 35, before turned, is fixed to the housing 21, 23 by a fixing band 41, 43. Therefore, when the two housings 21 and 23 are combined together as shown in FIG. 9(*b*), the half fitting hoods 25 and 27 are joined together to form a fitting hood.

However, with respect to the connector shown in FIG. 8, in a process of producing a wire harness, the wire harness is moved with the male tabs 13 and 15 exposed, and therefore there is a possibility that the male tabs 13 and 15 are deformed by a wire which drops and is inserted into a gap between the male tabs. On the other hand, in the connector of FIGS. 9(*a*), 9(*b*) and 10, although the male tabs 13 and 15 are protected by the fitting hoods 25 and 27, the fitting hoods 25 and 27 are of the half type, and are designed to be combined together to form one fitting hood, and therefore there is a possibility that these half fitting hoods are easily deformed and prized by an external force.

SUMMARY OF THE INVENTION

It is an object of this invention to provide a combined-type connector having fitting hoods which positively protect male tabs, and are less liable to be deformed.

In order to achieve the above object, according to the invention, there is provided a combined-type connector of a multi-stage construction comprising a main housing, and an auxiliary housing combined with the main housing, each of the main and auxiliary housings including terminal receiving chambers, respectively receiving male metal terminals, and a fitting hood covering male tabs of the male metal terminals, projecting respectively from the terminal receiving chambers, in a surrounding manner, and a press-connection opening being formed in one side of rear portions of the terminal receiving chambers, wherein the fitting hood of the main housing is formed by a rear wall and a peripheral wall defining four side walls, and a combination-purpose insertion port is formed in the rear wall of the fitting hood, and is directed and leads to a region disposed over the one side of the rear end portions of the terminal receiving chambers, wherein the fitting hood of the auxiliary housing is formed by a wall, disposed forwardly of the press-connection opening, and two walls disposed respectively at opposite sides of the wall, and is inserted into the fitting hood of the main housing through the insertion port, and the thus inserted fitting hood of the auxiliary housing has such a size that the three walls thereof are disposed in contiguous relation to an inner peripheral surface of the fitting hood of the main housing, and wherein there is provided a terminal cover for opening and closing the press-connection opening in the auxiliary housing.

Therefore, the male metal terminals are received respectively in the terminal receiving chambers in the auxiliary housing, and male tabs of these terminals project into the fitting hood formed by the three walls. Wires are press-connected respectively to the thus received male metal terminals through the press-connection opening, and then the opening is closed by the terminal cover. When the male metal terminals are received respectively in the terminal receiving chambers in the main housing, male tabs of these terminals project into the fitting hood of the main housing. Wires are press-connected respectively to the male metal terminals in the main housing through the press-connection opening. In this condition, when the fitting hood of the auxiliary housing is inserted through the combination-purpose insertion port formed in the rear wall of the fitting hood of the main housing, the three walls thereof are disposed in contiguous relation to the inner peripheral surface of the fitting hood of the main housing. At the same time, the press-connection opening in the terminal receiving chambers in the main housing is closed by the outer wall of the terminal receiving chambers in the auxiliary housing.

BRIEF DESCRIPTION OF THE DRAWINGS

FIG. 9(*b*) is a perspective view of the above conventional connector, showing a condition in which the housings are combined together.

DETAILED DESCRIPTION OF THE PREFERRED EMBODIMENT

Figure 1:
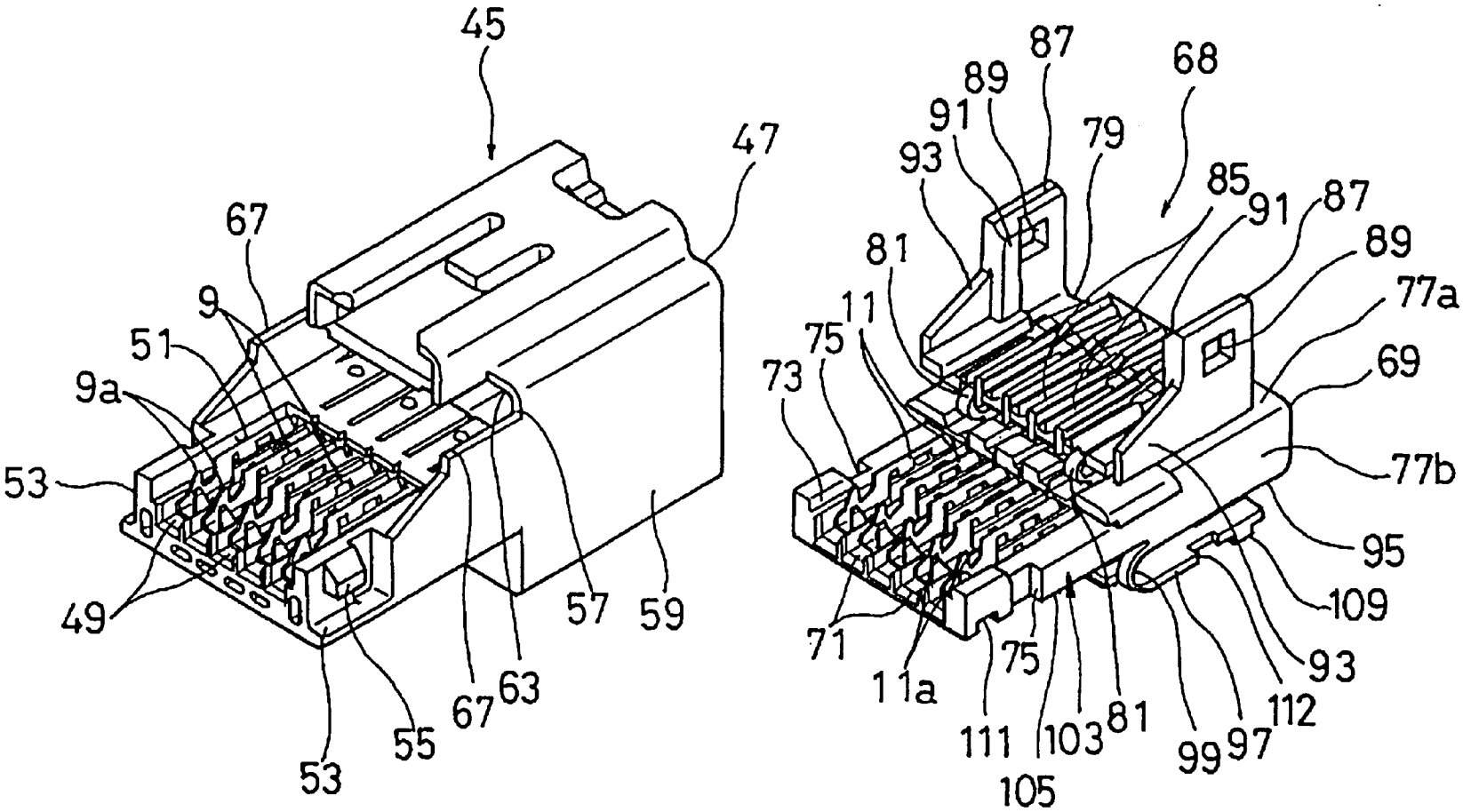
FIG. 1 is a perspective view of one preferred embodiment of the present invention, showing a condition before main and auxiliary housings are combined together.
Figure 2:
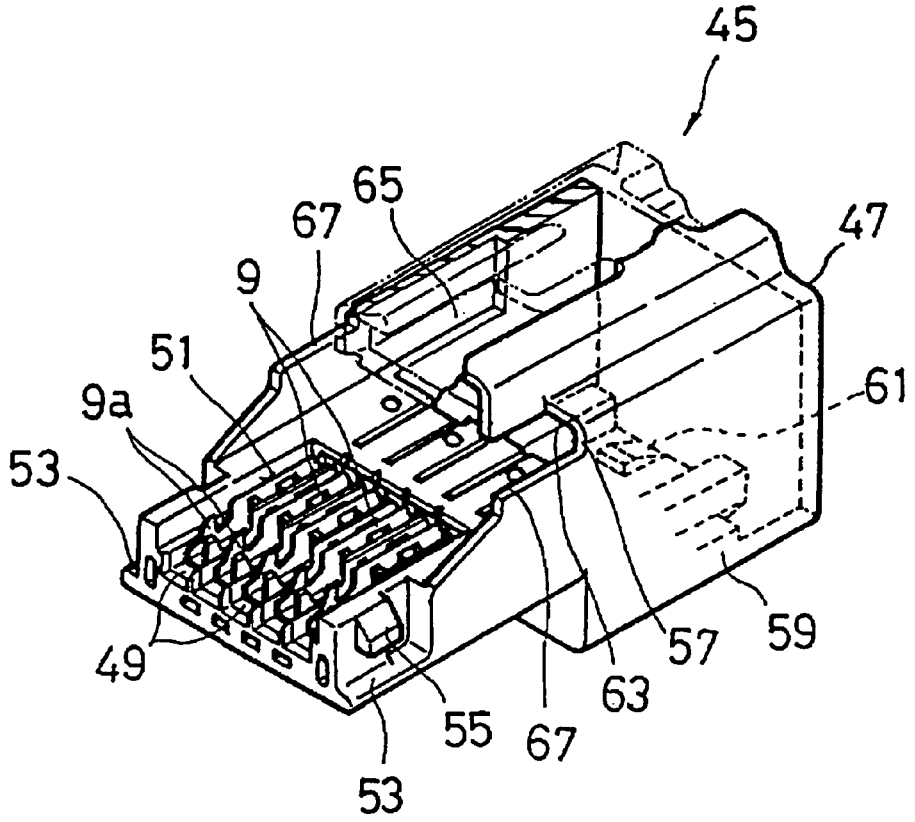
FIG. 2 is a partly-broken, perspective view of the main housing.
Figure 3:
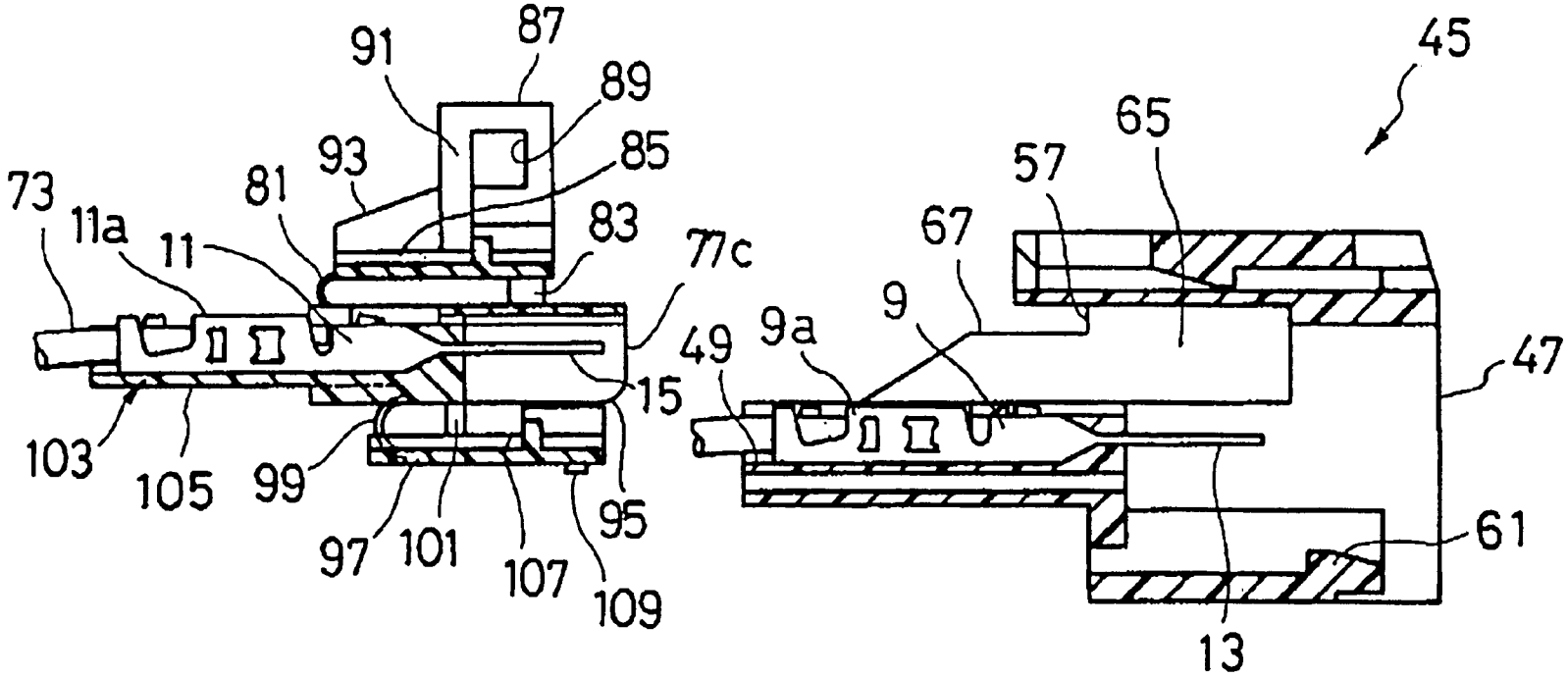
FIG. 3 is a cross-sectional view of the above embodiment, showing the condition before the main and auxiliary housings are combined together.
Figure 4:
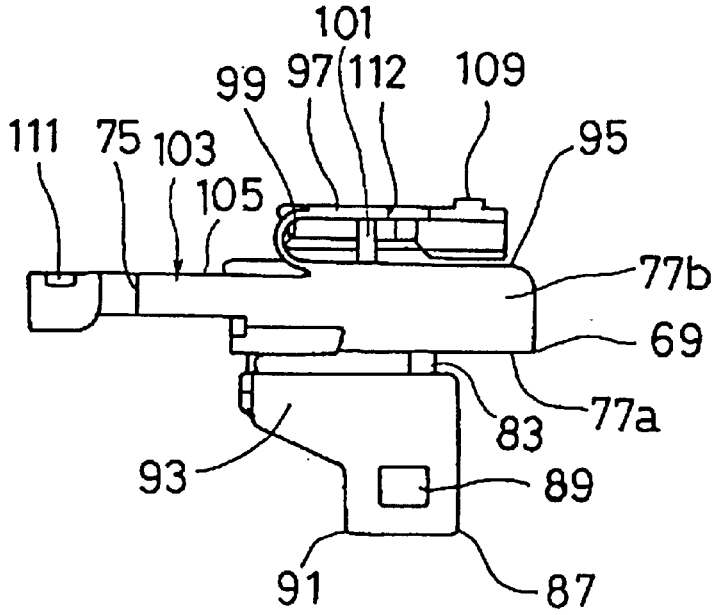
FIG. 4 is a side-elevational view of the auxiliary housing.
Figure 5:
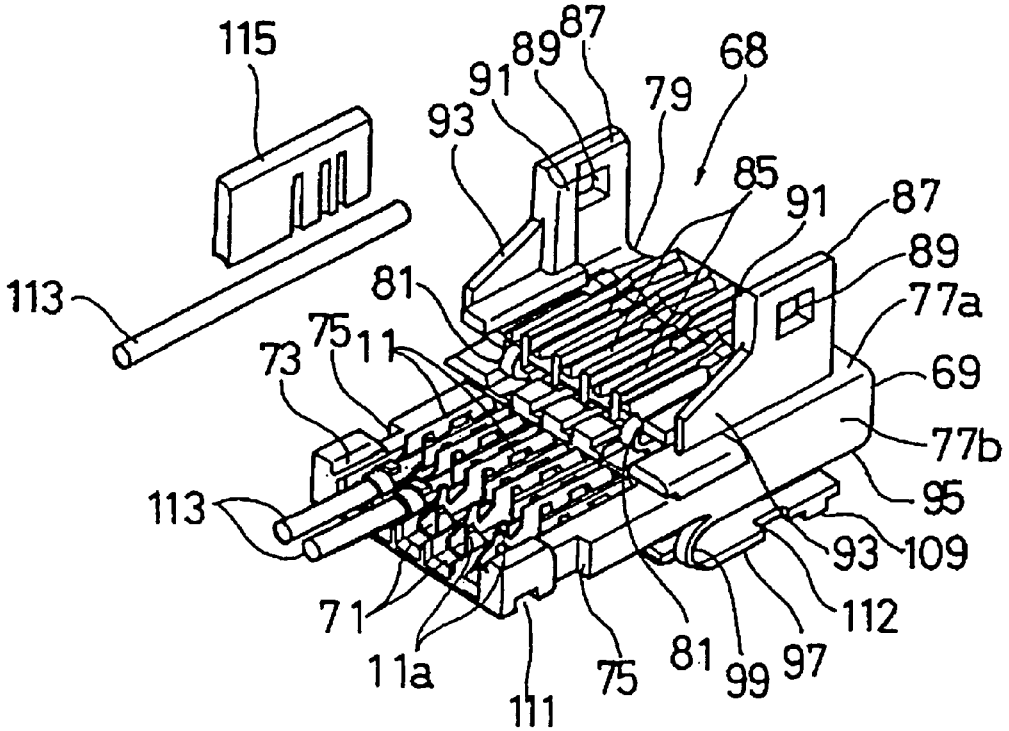
FIG. 5 is a perspective view of the auxiliary housing, showing an assembling operation.
Figure 6:
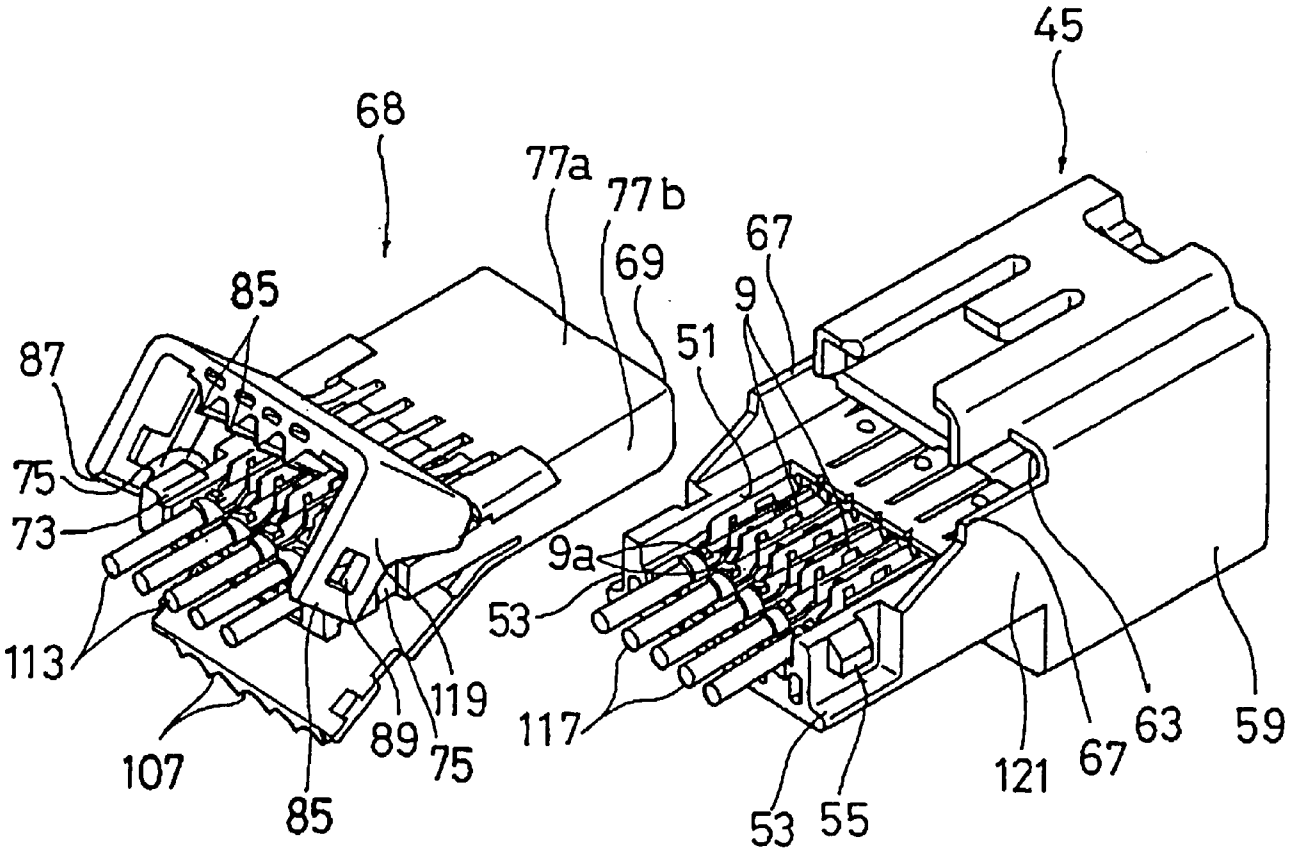
FIG. 6 is a perspective view of the main and auxiliary housings, showing the assembling operation.
Figure 7:
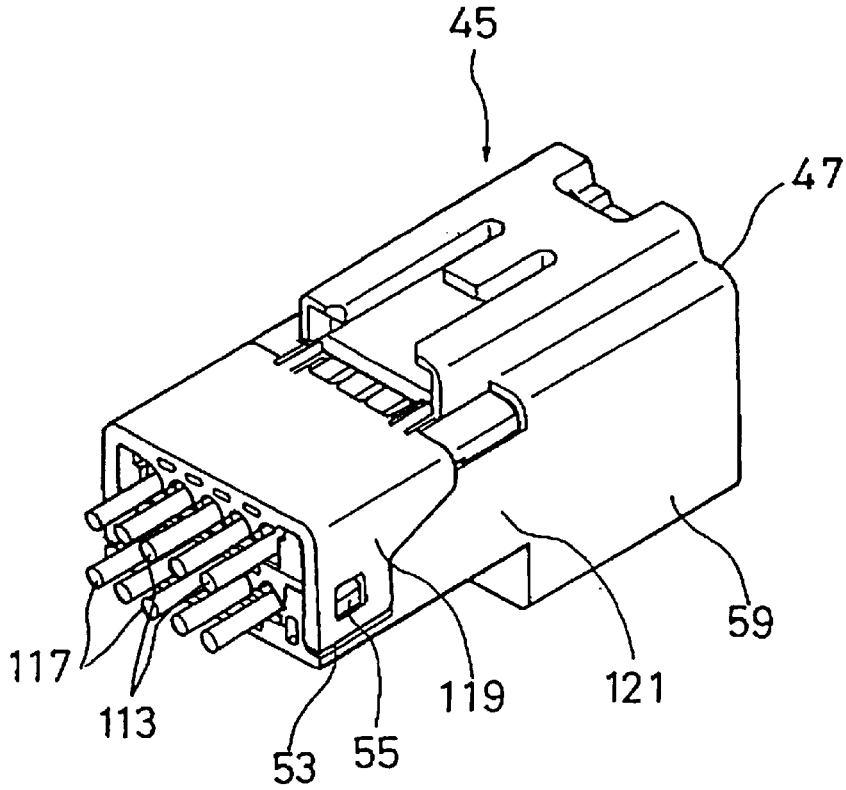
FIG. 7 is a perspective view showing a condition after the main and auxiliary housings are combined together.
Figure 8:
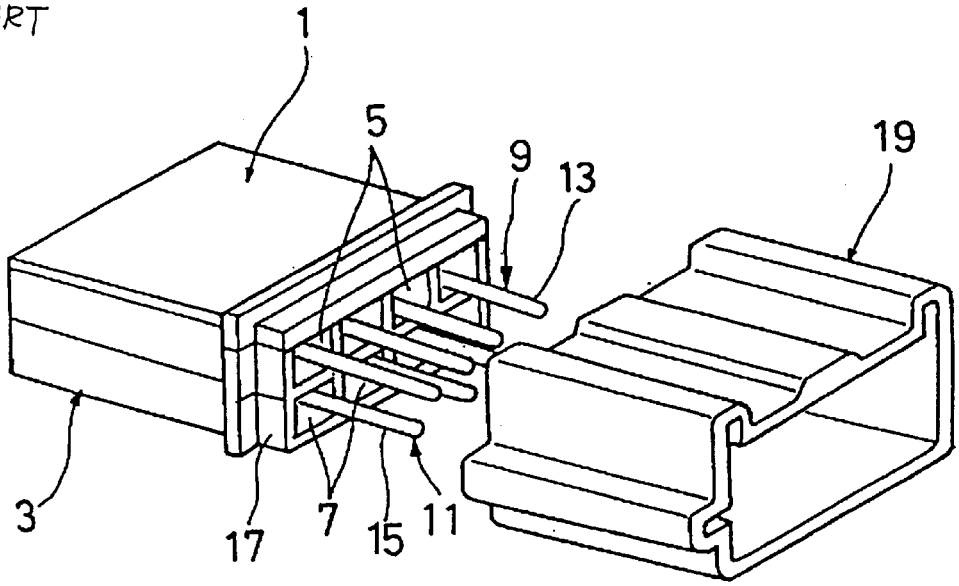
FIG. 8 PRIOR ART
FIG. 8 is a perspective view of a conventional connector, showing a hood in a separated condition.
Figure 9:
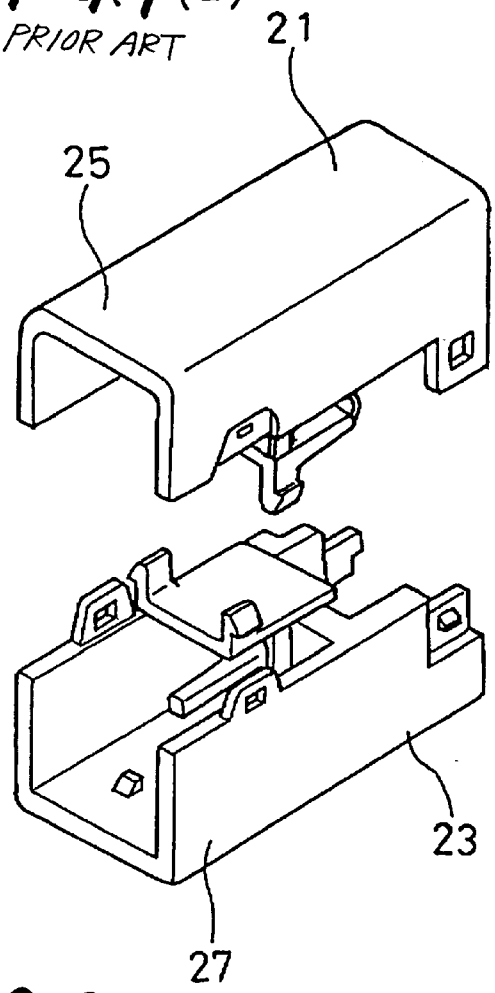
FIG. 9 (a) PRIOR ART
FIG. 9(*a*) is a perspective view of another conventional connector, showing a condition in which housings are separated from each other.
Figure 9:
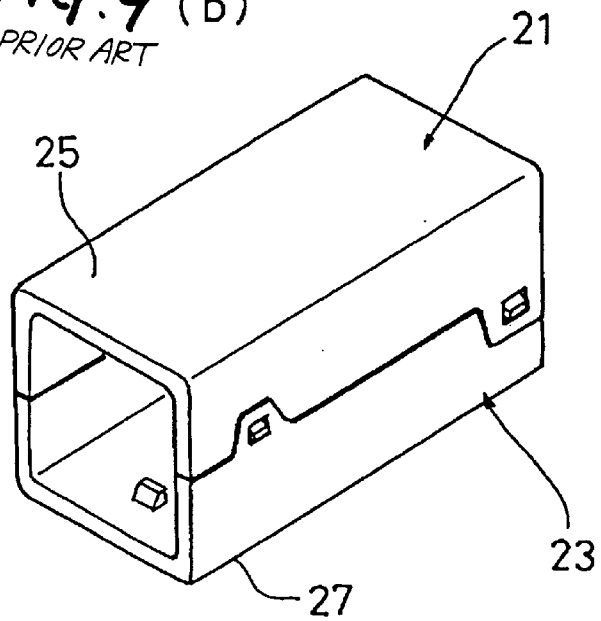
FIG. 9 (b) PRIOR ART
Figure 10:
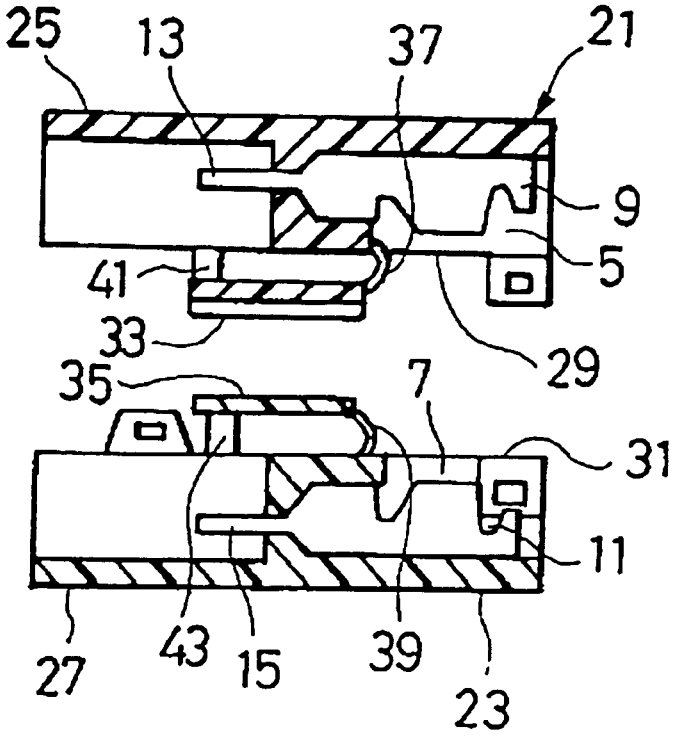
FIG. 10 PRIOR ART
FIG. 10 is a cross-sectional view of the above conventional connector, showing a condition in which the housings are separated from each other.

FIGS. 1 to 7 show one preferred embodiment of the present invention, and FIG. 1 is a perspective view of a main housing and an auxiliary housing, showing a condition before they are combined together, FIG. 2 is a partly-broken, perspective view of the main housing, FIG. 3 is a cross-sectional view of the main housing and the auxiliary housing, showing the condition before they are combined together, FIG. 4 is a side-elevational view of the auxiliary housing before it is combined with the main housing, and FIGS. 5 to 7 are perspective views showing a procedure of an assembling operation.

As shown in FIGS. 1 to 4, the main housing 45 includes a fitting hood 47 at its front portion in a fitting direction, and a plurality of juxtaposed terminal receiving chambers 49 provided at its rear portion. A press-connection opening 51 is formed on one side (i.e., upper side in FIG. 1) of the terminal receiving chambers 49 at rear portions thereof. A pair of recessed portions 53 are formed respectively in opposite side surfaces of the main housing 45 at the rear end portion thereof, that is, are disposed respectively on opposite sides of the group of terminal receiving chambers 49. A lock projection (lock retaining portion) 55 is formed on each of the recessed portions 53.

The fitting hood 47 of the main housing 45 is formed by a rear wall 57 and a peripheral wall 59 defining four side walls, and a lock portion 61 for locking the fitting connection of this connector to a male connector is formed at an upper portion of the fitting hood 47. The fitting hood 47 of the main housing 45 has a large size so as to receive a fitting hood of the auxiliary housing (which will be described later).

A combination-purpose insertion port 63 is formed in the rear wall 57 of the fitting hood 47 of the main housing 45, and is directed and leads to a region disposed over the opening 51 formed in the one side of the rear end portions of the terminal receiving chambers 49. A receiving portion 65 (in the form of a recess, see FIGS. 2 and 3) for receiving and positioning the fitting hood of the auxiliary housing is formed in an inner peripheral surface of the fitting hood 47, and is disposed forwardly of the insertion port 63. The main housing 45 has opposite side walls 67 disposed rearwardly of the insertion port 63.

Like the main housing 45, the auxiliary housing 68 to be combined with the main housing 45 includes the fitting hood 69, and a plurality of juxtaposed terminal receiving chambers 71. A press-connection opening 73 is formed on one side of the terminal receiving chambers 71 at rear portions thereof. A pair of lock grooves 75 are formed respectively in opposite side surfaces of the auxiliary housing 68, that is, are disposed respectively on opposite sides of the group of terminal receiving chambers 71.

The fitting hood 69 is formed by three walls 77*a* to 77*c*, that is, a wall, disposed forwardly of the opening 73, and walls disposed respectively at opposite sides of this wall. The fitting hood 69, formed by the three walls 77*a* to 77*c*, is inserted into the fitting hood 47 of the main housing 45 through the insertion port 63, and the fitting hood 69 has such a size as to be disposed in contiguous relation to the inner peripheral surface of the fitting hood 47 of the main housing 45 forming the receiving portion 65.

A terminal cover 79 (see FIGS. 1 and 5) for opening and closing the press-connection opening 73 is provided on the auxiliary housing 68. The terminal cover 79 is connected to the auxiliary housing 68 by hinges 81 provided forwardly of the press-connection opening 73. The terminal cover 79 is disposed in an inverted condition over the fitting hood 69, and is integrally fixed to the fitting hood 69 by fixing bands 83 which can be cut. For closing the opening 73 by the terminal cover 79, the fixing bands 83 are cut, and then the terminal cover 79 is turned or pivotally moved through the hinges 81.

A plurality of terminal retaining portions 85 are formed on the terminal cover 79, and each terminal retaining portion 85 can be disposed between the associated adjacent terminal receiving chambers 71. A pair of leg portions 87 (each in the form of a flat plate) are formed respectively at opposite widthwise sides of the terminal cover 79. The leg portions 87 have a sufficient length to be opposed respectively to the opposite side surfaces of the main housing 45, and each leg portion 87 has a lock hole (lock engagement portion) 89. An elongate projection 91 is formed on one side of the leg portion 87. A cover side wall 93 is formed in continuous relation to this elongate projection 91 (see FIGS. 1 and 5).

An auxiliary tab cover 97 is provided in opposed relation to an open side portion 95 (side other than the three walls 77*a* to 77*c*) of the fitting hood 69. The auxiliary tab cover 97 is connected to the auxiliary housing 68 by hinges 99, and is integrally fixed to this housing by fixing bands 101 which can be cut. The auxiliary tab cover 97 is formed by separating a portion from an outer wall 103 of the terminal receiving chambers 71 of the auxiliary housing 68 in a direction of a thickness thereof and by inverting or turning this portion toward the fitting hood 69. The auxiliary tab cover 97, when returned from its inverted condition, is superposed on a superposing surface 105 of the outer wall 103.

Terminal retaining portions 107 are formed on the auxiliary tab cover 97, and each terminal retaining portion 107 can be disposed between the associated adjacent terminal receiving chambers 49 of the main housing 45 to retain associated male metal terminals 9. The auxiliary tab cover 97 has notches 112 which can be made continuous with the lock grooves 75 (see FIGS. 1 and 5). A cover lock projection 109 is formed on the auxiliary tab cover 97, and a cover lock recess 111 is formed in the superposing surface 105 (see FIG. 1).

For assembling the connector, first, male metal terminals 11 are received respectively in the terminal receiving chambers 71 of the auxiliary housing 68, and wires 113 are press-connected respectively to press-connecting portions 11*a* of these terminals by a press-connecting jig 115, as shown in FIG. 5. Similarly, the male metal terminals 9 are received respectively in the terminal receiving chambers 49 of the main housing 45, and wires 117 are press-connected respectively to press-connecting portions 9*a* of these terminals.

For combining the auxiliary housing 68 with the main housing 45, the terminal cover 79 and the auxiliary tab cover 97 of the auxiliary housing 68 are inverted. This is done by cutting the fixing bands 83 and 101 and then by turning or inverting the terminal cover 79 and the auxiliary tab cover 97 through the hinges 81 and 99.

The inverted auxiliary tab cover 97 is superposed on the superposing surface 105, and the cover lock projection 109 is engaged in the cover lock recess 111 (see FIG. 1), thereby locking this superposed condition. In this condition, the notches 112 are made continuous with the lock grooves 75, respectively.

The auxiliary housing 68 in this condition is inserted into the insertion port 63 from the rear side of the main housing 45, as shown in FIG. 6. As a result of this inserting operation, the fitting hood 69 of the auxiliary housing 68 is inserted into the fitting hood 47 of the main housing 45, and is positioned by the receiving portion 65. Therefore, the combination of the auxiliary housing 68 with the main housing 45 can be carried out quite easily and accurately.

When the fitting hood 69 of the auxiliary housing 68 is inserted into the main housing, the inner surface of this fitting hood 69 is substantially flush with the inner surface of the fitting hood 47 of the main housing 45. When inserting the auxiliary housing 68 into the main housing 45, the side walls 67, disposed rearwardly of the insertion port 63, serve as guide means, thereby facilitating the insertion of the auxiliary housing 68.

Then, the terminal cover 79 is pushed down to close the press-connection opening 73 in the auxiliary housing 68. In this condition, each elongated projection 91 is fitted in the associated lock groove 75 and notch 112, thereby locking the terminal cover 79.

In this condition, the leg portions 87 of the auxiliary housing 68 are disposed adjacent respectively to the opposite side surfaces of the main housing 45, and the lock projections 55 of the main housing 45 are engaged respectively in the lock holes 89, thereby locking the auxiliary housing 68 to the main housing 45. Therefore, the main housing 45 and the auxiliary housing 68 are positively combined together without relative movement therebetween.

When the auxiliary housing 68 is combined with the main housing 45, each terminal retaining portion 107 of the auxiliary tab cover 97 is received in the press-connection opening 51 of the main housing 45, and is disposed between the associated terminal receiving chambers 49 to positively retain the associated male metal terminals 9 in the main housing 45.

When the auxiliary housing 68 is combined with the main housing 45, side surfaces 119 of the leg portions 87 of the terminal cover 79 are disposed flush respectively with the opposite side surfaces 121 of the main housing 45, thus forming continuous surfaces, as shown in FIG. 7. Therefore, the connector, constituted by combining the main housing 45 and the auxiliary housing 68 together, has a small number of projected portions, and the compact, combined construction can be achieved.

Before the two housings are combined together, male tabs 13 of the male metal terminals 9 in the main housing 45 are covered on all sides with the fitting hood 47, and therefore the male tabs 13 are positively protected.

Male tabs 15 of the male metal terminals 11 in the auxiliary housing 68 are covered on all sides with the fitting hood 69 and the auxiliary tab cover 97, and therefore are positively protected. Therefore, an external force is less liable to be applied to the male tabs 13 and 15 during shipping and during the manufacture of a wire harness, and the deformation of these male tabs is prevented.

The fitting hood 69 of the auxiliary housing 68 is designed to be inserted into the fitting hood 47 of the main housing 45, and therefore after the two housings are combined together, the two fitting hoods are joined together in a substantially integral manner, thus providing the construction of a high strength capable of withstanding deformation and prizing. The terminal cover 79 and the auxiliary tab cover 97 are formed integrally with the auxiliary housing 68 through the fixing bands 83 and 101, and the covers 79 and 97 and the auxiliary housing 68 can be molded into an integral or one-piece construction, and the molding can be effected quite easily. Besides, these can be handled as one piece, and therefore when the male metal terminals 11 are to be mounted in the auxiliary housing, the handling is easy, and the management of the parts is quite easy.

In the above embodiment, although the auxiliary tab cover 97 is provided, the provision of this cover 97 may be omitted. In this case, also, the male tabs 15 of the male metal terminals 11 in the auxiliary housing 68 are covered with the fitting hood 69 formed by the three walls, and are protected by this fitting hood 69 against deformation.

In the invention, the male tabs of the male metal terminals 13 and 15, received in each of the main and auxiliary housings, project into the fitting hood, and with this construction the male tabs are protected from an external force, and are prevented from deformation during the manufacture of the wire harness. After the two housings are combined together, the fitting hood of the auxiliary housing, formed by the three walls, is closely fitted in the fitting hood formed by the peripheral wall defining the four side walls, and therefore the deformation and prizing are prevented, and there can be provided the combined-type connector having high durability.

What is claimed is:

1. A combined-type connector of a multi-stage construction comprising a main housing, and an auxiliary housing combined with said main housing, each of said main and auxiliary housings including terminal receiving chambers, respectively receiving male metal terminals, and a fitting hood covering male tabs of the male metal terminals in a surrounding manner, said male metal terminals projecting respectively from said terminal receiving chambers, and a press-connection opening being formed in one side of rear portions of said terminal receiving chambers of said auxiliary housing, wherein said fitting hood of said main housing is formed by a rear wall and a peripheral wall defining four side walls, and a combination-purpose insertion port is formed in the rear wall of the fitting hood of said main housing, and is directed and leads to a region disposed over rear end portions of said terminal receiving chambers of said main housing, wherein said fitting hood of said auxiliary housing is formed by a first wall, disposed forwardly of the press-connection opening, and second and third walls disposed respectively at opposite sides of said first wall, and is inserted into said fitting hood of said main housing through the insertion port, and the thus inserted fitting hood of said auxiliary housing has such a size that the first, second and third walls thereof are disposed in contiguous relation to an inner peripheral surface of said fitting hood of said main housing, and wherein there is provided a terminal cover for opening and closing the press-connection opening in said auxiliary housing.

2. The combined-type connector according to claim 1, wherein a receiving portion for receiving and positioning said fitting hood of said auxiliary housing is formed in an inner peripheral surface of said fitting hood of said main housing, and is disposed forwardly of the insertion port.

3. The combined-type connector according to claim 1, wherein said terminal cover is connected to said auxiliary housing by a hinge provided forwardly of the press-connection opening, and is fixed to said auxiliary housing by a fixing band which can be cut, and when said fixing band is cut, said terminal cover is pivotable to close the press-connection opening.

4. The combined-type connector according to claim 1, wherein said terminal cover has terminal retaining portions for retaining the male metal terminals mounted in said auxiliary housing.

5. The combined-type connector according to claim 1, wherein a pair of leg portions are formed respectively at opposite widthwise sides of said terminal cover, and when said terminal cover closes the press connection opening, the leg portions are opposed respectively to opposite side surfaces of said main housing, and each of the leg portions has a lock engagement portion while each of the opposite side surfaces of said main housing has a lock retaining portion engageable in the lock engagement portion.

6. The combined-type connector according to claim 1, wherein an auxiliary tab cover is provided on a side of said auxiliary housing opposite to said fitting cover, and the auxiliary tab cover is connected to said auxiliary housing by a hinge, and is fixed thereto by a fixing band which can be cut, and the auxiliary tab cover is formed by separating a portion from an outer wall of said terminal receiving chambers of said auxiliary housing in a direction of a thickness thereof, and by inverting this portion, and the auxiliary tab cover is pivotable through the hinge to be superposed on the outer wall of said terminal receiving chambers.

7. The combined-type connector according to claim 6, wherein said auxiliary tab cover has terminal retaining portions for retaining the male metal terminals mounted in said main housing.

* * * * *